US006391127B1

(12) United States Patent
Wyatt-Mair et al.

(10) Patent No.: US 6,391,127 B1
(45) **Date of Patent: *May 21, 2002**

(54) METHOD OF MANUFACTURING ALUMINUM ALLOY SHEET

(75) Inventors: Gavin F. Wyatt-Mair, Layfayette; Donald G. Harrington, Danville; Ian Smith; William Betts, both of Pleasanton, all of CA (US)

(73) Assignee: Alcoa Inc., Pittsburgh, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/529,522

(22) Filed: Sep. 18, 1995

Related U.S. Application Data

(63) Continuation-in-part of application No. 07/902,718, filed on Jun. 23, 1992, now Pat. No. 5,514,228, and a continuation-in-part of application No. 08/248,555, filed on May 24, 1994, now Pat. No. 5,470,405, which is a continuation of application No. 07/902,936, filed on Jun. 23, 1992, now abandoned.

(51) Int. Cl.[7] ..... C22F 1/04

(52) U.S. Cl. ..... 148/551; 148/552; 148/692; 148/693

(58) Field of Search ..... 148/551, 552, 148/692, 693

(56) References Cited

U.S. PATENT DOCUMENTS 4,282,044 A * 8/1981 Robertson et al. ..... 148/2
5,192,378 A * 3/1993 Doherty et al. ..... 148/691

* cited by examiner

*Primary Examiner*—M. Alexandra Elve
(74) *Attorney, Agent, or Firm*—Edward L. Levine

(57) ABSTRACT

A method for manufacturing aluminum sheet stock which includes hot rolling an aluminum alloy sheet stock, quenching and coiling the feedstock. Then, in a second sequence, the feedstock is uncoiled, annealed and quenched to a temperature for cold rolling.

43 Claims, 2 Drawing Sheets

METHOD OF MANUFACTURING ALUMINUM ALLOY SHEET

CROSS-REFERENCE TO RELATED APPLICATIONS

This is a continuation-in-part of application Ser. No. 07/902,718, filed Jun. 23, 1992 now U.S. Pat. No. 5,514,228 and application Ser. No. 08/248,555 filed May 24, 1994 now U.S. Pat. No. 5,470,405, which in turn is a continuation of application Ser. No. 07/902,936 filed Jun. 23, 1992, now abandoned.

BACKGROUND OF THE INVENTION

The present invention relates to a continuous in-line process for economically and efficiently producing aluminum alloy sheet and, particularly, to a continuous, in-line process for producing aluminum alloy can stock.

Prior Art

Conventional manufacturing of flat rolled finish gauge stock has used batch processes which include an extensive sequence of separate steps. In the typical case, a large ingot is cast for rolling, and is then slowly cooled to ambient temperature. The ingot is then stored for inventory management. When an ingot is needed for further processing, it is first treated to remove defects such as segregation, pits, folds, liquation and handling damage by machining its surfaces. This operation is called scalping. Once the ingot has surface defects removed, it is preheated at a required temperature for several hours to ensure that the components of the alloy are uniformly distributed through the metallurgical structure, and then cooled to a lower temperature for hot rolling. While it is still hot, the ingot is subjected to breakdown hot rolling in a number of passes using reversing or non-reversing mill stands which serve to reduce the thickness of the ingot. After breakdown hot rolling, the ingot is then typically supplied to a tandem mill for hot finishing rolling, after which the sheet stock is coiled, air cooled and stored. The coil is then typically annealed in a batch step. The coiled stock is then further reduced to final gauge by cold rolling using unwinders, rewinders and single and/or tandem rolling mills.

Batch processes typically used in the aluminum industry require about seventeen different material handling operations to move ingots and coils between what are typically fourteen separate processing steps. Such operations are labor intensive, consume energy, and frequently result in product damage, re-working of the aluminum and even wholesale scrapping of product. And, of course, maintaining ingots and coils in inventory also adds to the manufacturing cost.

Aluminum scrap is generated in most of the foregoing steps, in the form of scalping chips, end crops, edge trim, scrapped ingots and scrapped coils. Aggregate losses through such batch processes typically range from 25 to 40%. Reprocessing the scrap thus generated adds 25 to 40% to the labor and energy consumption costs of the overall manufacturing process.

It has been proposed, as described in U.S. Pat. Nos. 4,260,419 and 4,282,044, to produce aluminum alloy can stock by a process which uses direct chill casting or minimill continuous strip casting. In the process there described, consumer aluminum can scrap is remelted and treated to adjust its composition. In one method, molten metal is direct chill cast followed by scalping to eliminate surface defects from the ingot. The ingot is then preheated, subjected to hot breakdown followed by continuous hot rolling, batch anneal and cold rolling to form the sheet stock. In another method, the casting is performed by continuous strip casting followed by hot rolling, coiling and cooling. Thereafter, the casting is annealed and cold rolled. The minimill process as described above requires about ten material handling operations to move ingots and coils between about nine process steps. Like other conventional processes described earlier, such operations are labor intensive, consume energy and frequently result in product damage. Scrap is generated in the rolling operations resulting in typical losses throughout the process of about 10 to 15%.

In the minimill process, annealing is typically carried out in a batch fashion with the aluminum in coil form. Indeed, the universal practice in producing aluminum alloy flat rolled products has been to employ slow air cooling of coils after hot rolling. Sometimes the hot rolling temperature is high enough to allow recrystallization of the hot coils before the aluminum cools down. Often, however, a furnace coil batch anneal must be used to effect recrystallization before cold rolling. Batch coil annealing as typically employed in the prior art requires several hours of uniform heating and soaking to achieve the anneal temperature. Alternatively, after breakdown cold rolling, prior art processes frequently employ an intermediate annealing operation prior to finish cold rolling. During slow cooling of the coils following annealing, some alloying elements present in the aluminum which had been in solid solution precipitate, resulting in reduced strength attributable to diminished solid solution hardening.

The foregoing patents (U.S. Pat. Nos. 4,260,419; and 4,282,044) employ batch coil annealing, but suggest the concept of flash annealing in a separate processing line. These patents suggest that it is advantageous to slow cool the alloy after hot rolling and then reheat it as part of a flash annealing process. That flash anneal operation has been criticized in U.S. Pat. No. 4,318,755 as not economical.

There is thus a need to provide a continuous, in-line process for producing aluminum alloy sheet which avoids the unfavorable economics embodied in conventional processes of the type described.

Substantial improvements in the manufacture of aluminum alloy sheet and can stock have been realized by the so-called micromill process described in the aforementioned co-pending applications. In the process disclosed and claimed therein, it is possible to produce aluminum alloy sheet stock and can stock in an economical manner by first providing an aluminum alloy feedstock, preferably by continuous strip casting. The feedstock, already hot from the casting operation, is hot rolled to reduce its thickness and is then annealed and solution heat treated without intermediate cooling to maintain the alloys in the aluminum in solid solution without precipitation. There-after, the feedstock is rapidly quenched and, where desired, subjected to cold rolling.

One of the principal advantages of the techniques described in the aforementioned application is that the steps of the micromill process are carried out continuously in an in-line sequence of steps which either eliminates or substantially minimizes the material handling operations which contribute undesirably to the cost of prior art processes. One of the principal advantages of the method described in those foregoing applications is that they can be located immediately adjacent to a can making plant to streamline material handling operations, lower shipping costs and minimize returning scrap costs.

A variation of that process is also disclosed and claimed in U.S. Pat. No. 5,356,495 in which use is made of two sequences of continuous, in-line operations. In the first sequence, the aluminum alloy feedstock is first subjected to hot rolling, coiling and coil self annealing and the second sequence includes the continuous, in-line sequence of uncoiling, quenching without intermediate cooling, cold rolling and coiling. The process as described in the latter patent has the advantage of eliminating the capital costs of an annealing furnace while nonetheless providing aluminum sheet and can stock having strength associated with aluminum alloys which have been heat treated.

It has now been discovered that aluminum alloys and can stock can be produced by utilizing two different sequences of inline continuous operation in which the first sequence includes a quenching step and the second sequence includes a rapid annealing step to provide aluminum alloy sheet stock and can stock having highly desirable metallurgical properties. It has been found that the rapid quenching in the first sequence of steps and the rapid heating followed by quenching in the second sequence of steps do not permit substantial precipitation of alloying elements present in the alloy and, thus, affords an aluminum alloy sheet and can stock having highly desirable metallurgical properties.

It is accordingly an object of the present invention to provide a process for producing aluminum alloy sheet stock which can be carried out in two in-line sequences without the need to employ many separate batch operations.

It is a more specific object of the invention to provide a process for commercially producing an aluminum alloy finish gauge sheet stock and aluminum alloy can stock in a semi-continuous process which can be operated economically and provide a product having equivalent or better metallurgical properties.

These and other objects and advantages of the invention appear more fully hereinafter from a detailed description of the invention.

SUMMARY OF THE INVENTION

The concepts of the present invention reside in the discovery that it is possible to combine casting, hot rolling and rapid quenching in a first continuous sequence of steps whereby the rapid quenching does not permit substantial precipitation of alloying elements from solid solution, thereby ensuring that the alloying elements remain in solid solution. Thereafter, in a second sequence of continuous, in-line steps, the aluminum alloy sheet can be flash annealed and rapidly quenched to ensure that alloying elements are in solid solution. The annealing followed by quenching in the second sequence of steps maximizes alloying elements in solid solution to strengthen the final product.

As used herein, the term "anneal" or "flash anneal" refers to a heating process to effect recrystallization of the grains of aluminum alloy to produce uniform formability and to control earing. Flash annealing, as referred to herein, refers to a rapid annealing process which serves to recrystallize the aluminum grains without causing substantial precipitation of intermetallic compounds. Slow heating and cooling of the aluminum alloy are known to cause substantial precipitation of intermetallic compounds. Therefore, it is an important concept of the invention that the heating, flash annealing and quenching be carried out rapidly. The continuous operation in place of batch processing facilitates precise control of process conditions and therefore metallurgical properties. Moreover, carrying out the process steps continuously and in-line eliminates costly materials handling steps, in-process inventory and losses associated with starting and stopping the processes.

The process of the present invention thus involves a new method for the manufacture of aluminum alloy sheet and can body stock utilizing the following process steps in two continuous, in-line sequences. In the first sequence, the following steps are carried out continuously and in-line.

(a) A hot aluminum feedstock is hot rolled to reduce its thickness;

(b) The hot reduced feedstock is thereafter rapidly quenched without substantial precipitation of alloying elements such as manganese to a temperature suitable for cold rolling;

(c) The quenched feedstock is, in the preferred embodiment of the invention, subjected to cold rolling to produce intermediate gauge sheet ; and (d) The feedstock is coiled for further processing.

Thereafter, in a second sequence, the following steps may be carried out continuously and in-line:

(a) The feedstock is uncoiled and, optionally, can be subjected to cold rolling if desired to further reduce the thickness of the stock;

(b) The feedstock is subjected to a flash anneal to effect recrystallization of the aluminum grains at a sufficiently rapid rate to avoid substantial precipitation of alloying elements as intermetallic compounds and, thereafter, the feedstock is subjected to a rapid quench, also effected rapidly so as to substantially avoid precipitation of alloying elements as intermetallic compounds; and (c) The quenched feedstock is thereafter subjected to further cold rolling and coiling to finish gauge.

It is an important concept of the invention that the flash anneal and the quench operation be carried out rapidly to ensure that alloying elements, and particularly manganese, as well as compounds of copper, silicon, mangnesium and aluminum, remain in solid solution. As is well known to those skilled in the art, the precipitation hardening of aluminum is a diffusion controlled phenomena which is time dependent. It is therefore important that the flash annealing and quenching operations of the second sequence of steps be carried out sufficiently rapidly that there is insufficient time to result in substantial precipitation of intermetallic compounds of copper, silicon, magnesium, iron, aluminum and manganese. At the same time, the annealing and quenching operations of the second step likewise minimize earing. That is particularly important when the aluminum alloy is a can stock alloy since earing is a phenomenon frequently found in the formation of cans from can body stock in which the plastic deformation to which the aluminum alloy is subjected is non-uniform. Thus, minimizing precipitation of intermetallic compounds raises the strength, allows recrystallization to be done at a lighter gauge, minimizes finish cold work and thereby reduces earing.

In accordance with a preferred embodiment of the invention, the strip is fabricated by strip casting to produce a cast thickness less than 1.0 inches, and preferably within the range of 0.06 to 0.2 inches. In another preferred embodiment, the width of the strip, slab or plate is narrow, contrary to conventional wisdom. This facilitates ease of in-line threading and processing, minimizes investment in equipment and minimizes cost in the conversion of molten metal to the sheet stock.

In accordance with yet another preferred embodiment of the invention, the feedstock is strip cast using the concepts described in co-pending application U.S. Pat. Nos. 5,515,908 and 5,564,491, the disclosures of which are incorporated herein by reference. In the method and apparatus described in the foregoing pending applications, the feedstock is strip cast on at least one endless belt formed of a heat conductive material to which heat is transferred during the molding process, after which the belt is cooled when it is not in contact with the metal. It is believed that the method and apparatus there described represents a dramatic improvement in the economics of strip casting.

In addition, the use of strip casting as described in the foregoing applications provides another significant advantage in that the molten metal is solidified in the strip casting apparatus, followed immediately by rolling and by quenching. That sequence of operations likewise ensures that no substantial precipitation of alloying elements in the form of intermetallic compounds can occur. The strip caster is operated at high speeds and, because it is followed by substantially immediate quenching, there is insufficient time within which to permit precipitation of alloying elements. That serves to provide improved metallurgical properties in the aluminum strip thus formed.

DETAILED DESCRIPTION OF THE INVENTION

Figure 1:
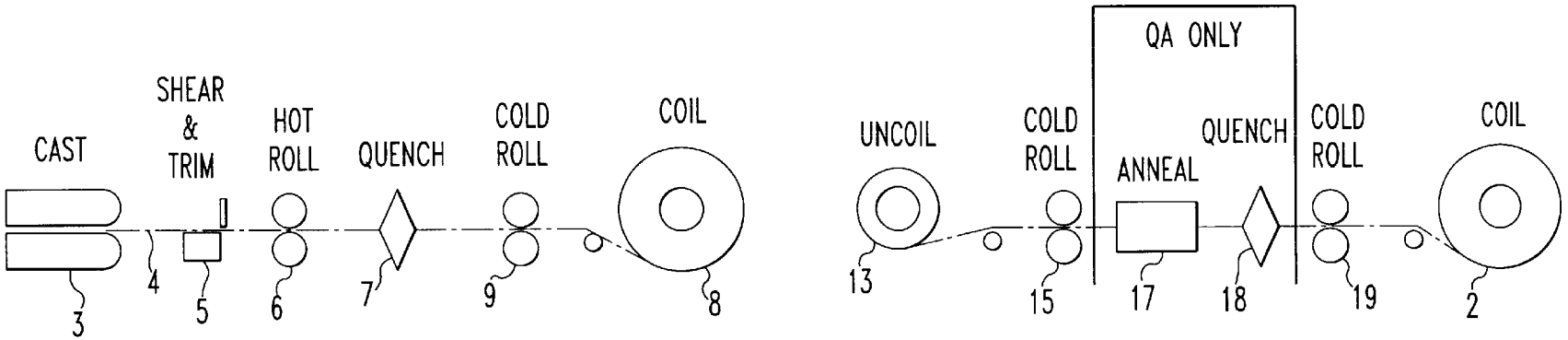
FIG. 1 is a schematic illustration of the two continuous sequences of steps employed in the practice of the invention.

The sequence of steps employed in the preferred embodiment of the invention are illustrated in FIG. 1. One of the advances of the present invention is that the processing steps for producing sheet stock can be arranged in two continuous in-line sequences whereby the various process steps are carried out in sequence. The practice of the invention in a narrow width (for example, 12 inches) make it practical for the present process to be conveniently and economically located in or adjacent to sheet stock customer facilities. In that way, the process of the invention can be operated in accordance with the particular technical and throughput needs for sheet stock users.

In the preferred embodiment, molten metal is delivered from a furnace not shown in the drawing to a metal degassing and filtering device to reduce dissolved gases and particulate matter from the molten metal, also not shown. The molten metal is immediately converted to a cast feedstock 4 in casting apparatus 3. As used herein, the term "feedstock" refers to any of a variety of aluminum alloys in the form of ingots, plates, slabs and strips, delivered to the hot rolling step at the required temperature. Herein, an aluminum "ingot" typically has a thickness ranging from about 6 inches to about 36 inches, and is usually produced by direct chill casting or electromagnetic casting. An aluminum "plate", on the other hand, herein refers to an aluminum alloy having a thickness from about 0.5 inches to about 6 inches, and is typically produced by direct chill casting or electromagnetic casting alone or in combination with hot rolling of an aluminum alloy. The term "slab" is used herein to refer to an aluminum alloy having a thickness ranging from 0.375 inches to about 3 inches, and thus overlaps with an aluminum plate. The term "strip" is herein used to refer to an aluminum alloy in sheet form, typically having a thickness less than 0.375 inches. In the usual case, both slabs and strips are produced by continuous casting techniques well known to those skilled in the art.

The feedstock employed in the practice of the present invention can be prepared by any of a number of casting techniques well known to those skilled in the art, including twin belt casters like those described in U.S. Pat. No. 3,937,270 and the patents referred to therein. In some applications, it may be preferable to employ as the technique for casting the aluminum strip the method and apparatus described in co-pending application Serial No. 08/184,581, U.S. Pat. Nos. 5,515,908 and 5,564,491.

Figure 2:
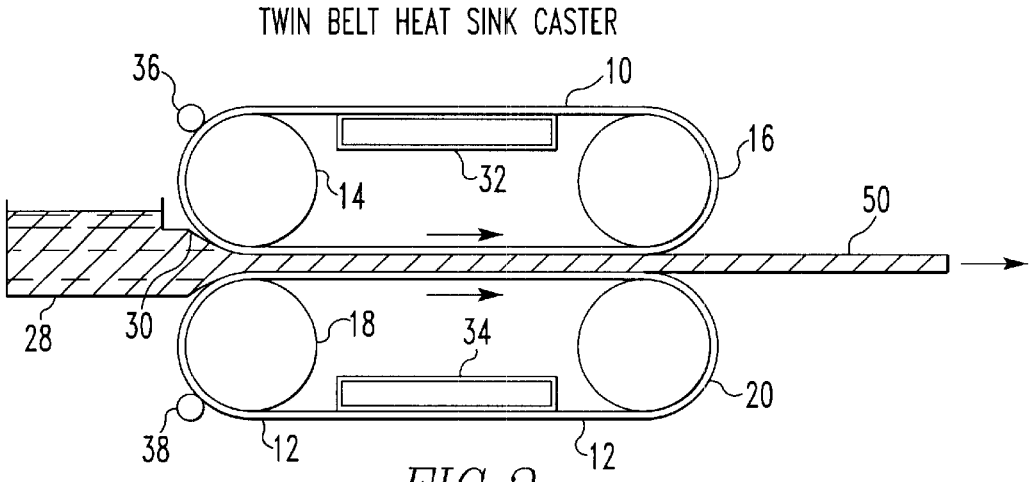
FIG. 2 is a schematic illustration of preferred strip casting apparatus used in the practice of the invention.

The strip casting technique described in the foregoing co-pending applications which can advantageously be employed in the practice of this invention is illustrated in FIG. 2 of the drawing. As there shown, the apparatus includes a pair of endless belts 10 and 12 carried by a pair of upper pulleys 14 and 16 and a pair of corresponding lower pulleys 18 and 20. Each pulley is mounted for rotation, and is a suitable heat resistant pulley. Either or both of the upper pulleys 14 and 16 are driven by suitable motor means or like driving means not illustrated in the drawing for purposes of simplicity. The same is true for the lower pulleys 18 and 20. Each of the belts 10 and 12 is an endless belt and is preferably formed of a metal which has low reactivity with the aluminum being cast. Low-carbon steel or copper are frequently preferred materials for use in the endless belts.

The pulleys are positioned, as illustrated in FIG. 2, one above the other with a molding gap therebetween corresponding to the desired thickness of the aluminum strip being cast.

Molten metal to be cast is supplied to the molding gap through suitable metal supply means such as a tundish 28. The inside of the tundish 28 corresponds substantially in width to the width of the belts 10 and 12 and includes a metal supply delivery casting nozzle 30 to deliver molten metal to the molding gap between the belts 10 and 12.

The casting apparatus also includes a pair of cooling means 32 and 34 positioned opposite that position of the endless belt in contact with the metal being cast in the molding gap between the belts. The cooling means 32 and 34 thus serve to cool belts 10 and 12, respectively, before they come into contact with the molten metal. In the preferred embodiment illustrated in FIG. 2, coolers 32 and 34 are positioned as shown on the return run of belts 10 and 12, respectively. In that embodiment, the cooling means 32 and 34 can be conventional cooling devices such as fluid nozzles positioned to spray a cooling fluid directly on the inside and/or outside of belts 10 and 12 to cool the belts through their thicknesses. Further details respecting the strip casting apparatus may be found in the cited co-pending applications.

Returning to FIG. 1, the feedstock 4 from the strip caster 3 is moved through optional shear and trim station 5 into one or more hot rolling stands 6 where its thickness is decreased. Immediately after the hot rolling operation has been performed in the hot rolling stands 6, the feedstock is passed to a quenching station 7 wherein the feedstock, still at an elevated temperature from the casting operation, is contacted with a cooling fluid. Any of a variety of quenching devices may be used in the practice of the invention. Typically, the quenching station is one in which a cooling fluid, either in liquid or gaseous form, is sprayed onto the hot feedstock to rapidly reduce its temperature. Suitable cooling fluids include water, liquified gases such as carbon dioxide or nitrogen, and the like. It is important that the quench be carried out quickly to reduce the temperature of the hot feedstock rapidly to prevent substantial precipitation of alloying elements from solid solution.

It will be appreciated by those skilled in the art that there can be expected some insignificant precipitation of intermetallic compounds that do not affect the final properties. Such minor precipitation has no affect on those final properties either by reason of the fact that the intermetallic compounds are small and redissolve during the rapid annealing step in any case, or their volume and type have a negligible effect on the final properties. As used herein, the term "substantial" refers to precipitation which affects the final sheet properties.

In general, the temperature is reduced from a temperature ranging from about 600 to about 950° F. to a temperature below 550° F., and preferably below 450° F. Thereafter, the feedstock can be coiled using conventional coiling apparatus in a coiler 8. Alternatively, before coiling, the feedstock 4 can be subjected to cold rolling as an optional step prior to cooling.

Figure 3:
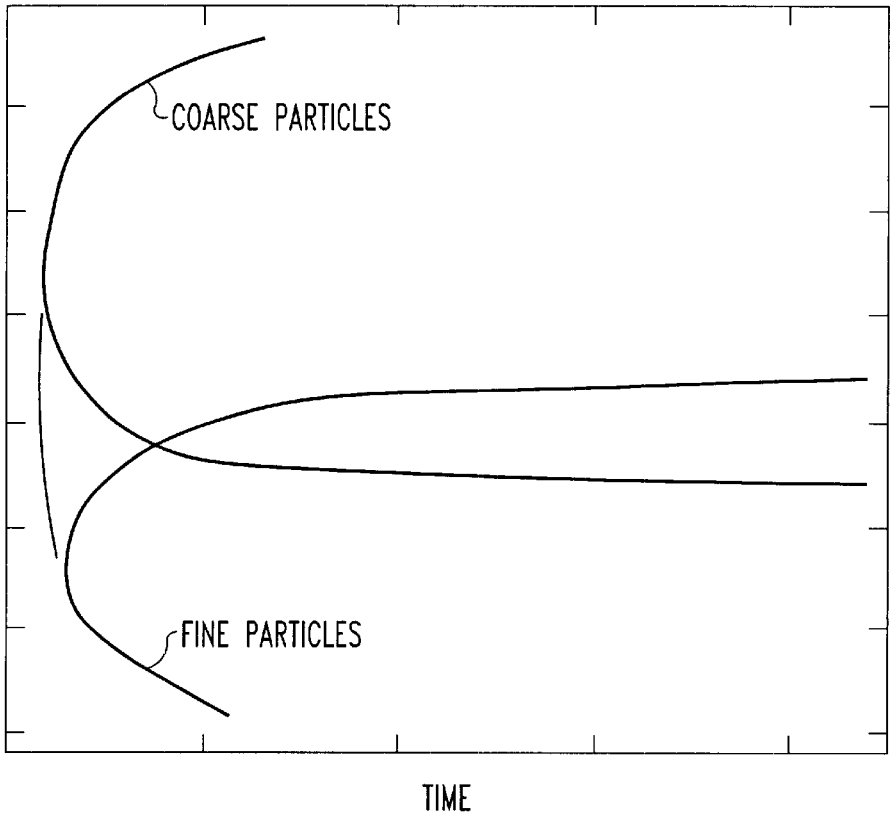
FIG. 3 is a generalized time/temperature-transformation diagram for aluminum alloys illustrating how rapid heating and quenching serves to eliminate or at least substantially minimize precipitation of alloying elements in the form of intermetallic compounds.

The importance of rapid cooling following hot rolling is illustrated by FIG. 3 of the drawings, a generalized graphical representation of the formation of precipitates of alloying elements as a function of time and temperature. Such curves, which are generally known in the art as time/temperature-trans-formation or "C" curves, show the formation of coarse and fine particles formed by the precipitation of alloying elements as intermetallic compounds as an aluminum alloy is heated or cooled. Thus, the cooling afforded by the quench operation immediately following hot rolling is effected at a rate such that the temperature-time line followed by the aluminum alloy during the quench remains between the ordinate and the curves. That ensures that cooling is effected sufficiently rapidly so as to avoid substantial precipitation of such alloying elements as intermetallic compounds.

Once coiled, the cooled feedstock can be stored until needed. The temperature of the feedstock has been previously rapidly reduced in the quenching station 7 to prevent substantial precipitation of alloying elements and compounds thereof; hence the coil can be stored indefinitely.

In the second sequence of steps, when there is a need to provide finished alloy, the stored coil can then be subjected to the second continuous, in-line sequence of steps, also as shown in FIG. 1. The coil previously formed is placed in an uncoiler 13 from which it is passed to an optional cold rolling station 15 and then to a flash annealing furnace 17 in which the coil is rapidly heated. That rapid annealing step provides an improved combination of metallurgical properties such as grain size, strength and formability. Because the feedstock is rapidly heated, substantial precipitation of alloying elements likewise is avoided. Thus, the heating operation should be carried out to the desired annealing or recrystallization temperature such that the temperature-time line followed by the aluminum alloy does not cross the C-curves illustrated in FIG. 3 in such a way as to cause substantial precipitation. Immediately following the heater 17 is a quench station 18 in which the strip is rapidly cooled by means of a conventional cooling fluid to a temperature suitable for cold rolling. Because the feedstock is rapidly cooled in the quench step 18, there is insufficient time to cause any substantial precipitation of alloying elements from solid solution. That facilitates higher than conventional strength. This reduces the amount of strengthening required by cold working, and less cold working reduces earing.

In the preferred embodiment of the invention, the feedstock is passed from the quenching step to one or more cold rolling stands 19 in which the feedstock is worked to harden the alloy and reduce its thickness to finish gauge. After cold rolling, the strip 4 is coiled a coiler 21.

As will be appreciated by those skilled in the art, it is possible to realize the benefits of the present invention without carrying out the cold rolling step in the cold mill 19 as part of the in-line process. Thus, the use of the cold rolling step is an optional process step of the present invention, and can be omitted entirely or it can be carried out in an off-line fashion, depending on the end use of the alloy being processed. As a general rule, carrying out the cold rolling step off-line decreases the economic benefits of the preferred embodiment of the invention in which all of the process steps are carried out in-line.

It is possible, and sometimes desirable, to employ appropriate automatic control apparatus; for example, it is frequently desirable to employ a surface inspection device for on-line monitoring of surface quality. In addition, a thickness measurement device conventionally used in the aluminum industry can be employed in a feedback loop for control of the process.

It has become the practice in the aluminum industry to employ wider cast strip or slab for reasons of economy. In the preferred embodiment of this invention, it has been found that, in contrast to this conventional approach, the economics are best served when the width of the cast feedstock 4 is maintained as a narrow strip to facilitate ease of processing and enable use of small decentralized strip rolling plants. Good results have been obtained where the cast feedstock is less than 24 inches wide, and preferably is within the range of 2 to 20 inches wide. By employing such narrow cast strip, the investment can be greatly reduced through the use of small, two-high rolling mills and all other in-line equipment. Such small and economic micromills of the present invention can be located near the points of need, as, for example, can-making facilities. That in turn has the further advantage of minimizing costs associated with packaging, shipping of products and customer scrap. Additionally, the volume and metallurgical needs of a can plant can be exactly matched to the output of an adjacent micromill.

In the practice of the invention, the hot rolling exit temperature is generally maintained within the range of 300 to 1000° F. Hot rolling is typically carried out in temperatures within the range of 300° F. to the solidus temperature of the feedstock. The annealing and solution heat treatment is effected at a temperature within the range of 600 to 1200° F. for less than 120 seconds, and preferably 0.1 to 10 seconds. Immediately following heat treatment at those temperatures, the feedstock in the form of strip 4 is water quenched to temperatures necessary to continue to retain alloying elements in solid solution and to cold roll (typically less than 400° F.).

As will be appreciated by those skilled in the art, the extent of the reductions in thickness effected by the hot rolling and cold rolling operations of the present invention are subject to a wide variation, depending upon the types of alloys employed, their chemistry and the manner in which they are produced. For that reason, the percentage reduction in thickness of each of the hot rolling and cold rolling operations of the invention is not critical to the practice of the invention. However, for a specific product, practices for reductions and temperatures must be used. In general, good results are obtained when the hot rolling operation effects reduction in thickness within the range of 15 to 99% and the cold rolling effects a reduction within the range from 10 to 85%. As will be appreciated by those skilled in the art, strip casting carried out in accordance with the most preferred embodiment of the invention provides a feedstock which does not necessarily require a hot rolling step as outlined above. In those instances where the feedstock is produced by such strip casting techniques, the hot rolling step can be avoided altogether and, thus, is optional in the practice of the invention.

The concepts of the present invention are applicable to a wide range of aluminum alloys for use in a wide variety of products. In general, alloys from the 1000, 2000, 3000, 4000, 5000, 6000, 7000 and 8000 series are suitable for use in the practice of the present invention.

Having described the basic concepts of the invention, reference is now made to the following example which is provided by way of illustration of the practice of the invention. The sample feedstock was as cast aluminum alloy solidified rapidly enough to have secondary dendrite arm spacings below 10 microns.

EXAMPLE

In Examples 1 and 2, an aluminum alloy having the composition set forth in Table 1 and a prior art example are each carried out by casting aluminum alloys using a twin belt strip caster in which the belts are cooled while they are not in contact with either molten metal or the cast metal strip to yield a cast metal strip having a thickness of 0.10 inches. The cast strip is then processed as indicated in the Table for each of the examples to yield the products whose characteristics are set forth in Table 1. The prior art process illustrated is that in U.S. Pat. No. 4,282,044, except that the strip casting in the prior art process is carried out using the same technique as Examples 1 and 2. Table 1 also sets forth typical data for aluminum alloys having the composition set forth therein for AA3104 and AA5182 produced by the conventional ingot process in which the ingots have thicknesses of 26 inches. Can buckle strengths are set forth for all alloys except 5182, and have been corrected to 0.0112 inch gauge for ease of comparison.

The Examples illustrate the unexpected results produced by the present invention. Rapid quenching instead of slow cooling in accordance with the concepts of this invention results in significantly higher strength, either with or without hot rolling. The strengths obtained in the practice of this invention for low alloy content aluminum alloys approaches that of AA5182, a high alloy content aluminum alloy typically used for can lids and tabs, as the data shows. Not only does the process of the invention provide superior strength, it provides equivalent or lower earing as well.

TABLE 1

| | Invention Examples | | Prior | Typical Ingot Process | |
|---|---|---|---|---|---|
| | Example 1 | Example 2 | Art | 3104 | 5182 |
| Si | 0.30 | 0.26 | 0.39 | 0.18 | 0.10 |
| Fe | 0.29 | 0.33 | 0.44 | 0.45 | 0.20 |
| Cu | 0.27 | 0.20 | 0.23 | 0.20 | 0.05 |
| Mn | 0.95 | 0.59 | 0.97 | 1.00 | 0.35 |
| Mg | 0.93 | 0.84 | 0.96 | 1.10 | 4.50 |
| Cast Gauge, inch | 0.10 | 0.09 | 0.10 | 26 | 26 |
| Hot Rolling | 0 | 53% | 46% | 99% | 99% |
| Cooling | Quench | Quench | Slow | Slow | Slow |
| Anneal Type | Rapid | Rapid | Rapid | Slow | Slow |
| Anneal Gauge, inch | 0.031 | 0.025 | 0.027 | 0.110 | 0.110 |
| Anneal Temp, ° F. | 1075 | 1000 | 930 | 650 | 650 |
| Finish Gauge, inch | 0.0106 | 0.0109 | 0.0116 | 0.0112 | 0.0108 |

TABLE 1-continued

| | Invention Examples | | Prior | Typical Ingot Process | |
|---|---|---|---|---|---|
| | Example 1 | Example 2 | Art | 3104 | 5182 |
| Ultimate Strength, ksi | 51.5 | 46.2 | 39.8 | 44.0 | 58.0 |
| Yield Strength, ksi | 46.6 | 41.7 | 37.5 | 41.0 | 50.0 |
| Elongation | 8.1% | 5.3% | 1.2% | 6.0% | 8.0% |
| Cup Earing | NA | 2.0% | 3.4% | 2.2% | NA |
| Can Buckle Strength, psi | NA | 100.7 | 78.5 | 93.0 | NA |

It will be understood that various changes and modifications can be made in the details of procedure, formulation and use without departing from the spirit of the invention, especially as defined in the following claims.

What is claimed is:

1. A method for manufacturing aluminum alloy sheet stock in which the process is carried out in two sequences of continuous-in-line operations comprising, in the first sequence, continuously casting a hot aluminum feedstock and rapidly, without intermediate heat treatment, continuously hot rolling said hot aluminum feedstock to reduce its thickness, rapidly quenching the hot feedstock thereafter to reduce its temperature and rapidly coiling the cooled feedstock, and, in the second continuous, in-line sequence, the steps of uncoiling the coiled feedstock, rapidly heating the feedstock to anneal the feedstock and effect recrystallization thereof without causing substantial precipitation of alloying elements as intermetallic compounds, and quenching the annealed feedstock to avoid substantial precipitation of alloying elements.

2. A method as defined in claim 1 wherein the feedstock is provided by continuous strip or slab casting.

3. A method as defined in claim 1 wherein the feedstock is formed by depositing molten aluminum alloy on an endless belt formed of a heat conductive material whereby the molten metal solidifies to form a cast strip, and the endless belt is cooled when it is not in contact with the metal.

4. A method as defined in claim 1 which includes, as a continuous, in-line step, cold rolling the feedstock after quenching in the first sequence.

5. A method as defined in claim 1 wherein the aluminum alloy feedstock is can body sheet stock.

6. A method as defined in claim 1 which includes, as a continuous, in-line step, cold rolling the feedstock immediately following annealing and quenching in the second sequence.

7. A method as defined in claim 6 which includes the further step of forming cups from the cold rolled sheet stock.

8. A method as defined in claim 6 which includes the step of coiling the cold rolled feedstock after cold rolling.

9. A method as defined in claim 1 which includes, as an off-line step, cold rolling the annealed feedstock.

10. A method as defined in claim 1 wherein the hot rolling reduces the thickness of the feedstock by 15 to 99%.

11. A method as defined in claim wherein the feedstock is heated to an annealing temperature within the range of 600 to 1200° F.

12. A method as defined in claim 1 wherein the hot rolling of the feedstock is carried out at a temperature within the range of 300° F. to the solidus temperature of the feedstock.

13. A method as defined in claim 1 wherein the hot rolling exit temperature is within the range of 300 to 1000° F.

14. A method as defined in claim 1 wherein the annealing is carried out in less than 120 seconds.

15. A method as defined in claim 1 wherein the annealing is carried out in less than 10 seconds.

16. A method as defined in claim 1 wherein the reduced feedstock is quenched to a temperature less than 550° F.

17. A method as defined in claim 1 wherein the cold rolling step effects a reduction in the thickness of the feedstock of 10 to 85%.

18. A method for manufacturing aluminum alloy sheet stock in which the process is carried out in two sequences of continuous, in-line operation comprising, in the first sequence, continuously strip casting an aluminum alloy feedstock between a pair of endless moving belts, and rapidly without intermediate heat treatment, continuously hot rolling the aluminum feedstock to reduce its thickness, rapidly quenching the hot feedstock thereafter to reduce its temperature and rapidly coiling the cooled feedstock, and, in the second continuous, in-line sequence, the steps of uncoiling the coiled feedstock, rapidly heating the feedstock to anneal the feedstock and effect recrystallization thereof without causing substantial precipitation of alloying elements as intermetallic compounds, and immediately and rapidly quenching the annealed feedstock to avoid substantial precipitation of alloying elements.

19. A method as defined in claim 18 which includes, as a continuous, in-line step, cold rolling the feedstock after quenching in the first sequence.

20. A method as defined in claim 18 wherein the aluminum alloy feedstock is can body sheet stock.

21. A method as defined in claim 18 wherein the hot rolling reduces the thickness of the feedstock by 15 to 99%.

22. A method as defined in claim 18 wherein the feedstock is heated to an annealing temperature within the range of 600 to 1200° F.

23. A method as defined in claim 18 wherein the annealing is carried out in less than 120 seconds.

24. A method for manufacturing aluminum alloy sheet stock in which the process is carried out in two sequences of continuous, in-line operating comprising, in the first sequence, continuously strip casting an aluminum alloy feedstock between a pair of endless moving belts to provide a hot aluminum alloy feedstock and, without intermediate heat treatment, rapidly, quenching the feedstock thereafter to reduce its temperature and rapidly coiling the feedstock and, in the second continuous, in-line sequence, rapidly heating the feedstock to anneal the feedstock and effect recrystallization thereof without causing substantial precipitation of alloying elements as intermetallic compounds, and immediately and rapidly quenching the annealed feedstock to substantially avoid precipitation of alloying elements to a temperature for cold rolling.

25. A method as defined in claim 24 wherein the aluminum alloy feedstock is can body sheet stock.

26. A method as defined in claim 24 which includes the step of coiling the quenched feedstock in the first sequence.

27. A method as defined in claim 24 which includes the step of hot rolling the aluminum alloy feedstock continuously and in-line immediately following strip casting in the first sequence.

28. A method as defined in claim 1, wherein prior to hot rolling in the first sequence, aluminum can scrap is melted and continuously strip cast into said hot aluminum feedstock, the cast strip having a secondary dendrite arm spacing of below 10 $\mu$m.

29. A method as described in claim 1, wherein the quenching in the first sequence cools the hot rolling feedstock at a rate fast enough to prevent substantial precipitation of alloying elements from solid solution.

30. A method as defined in claim 1, wherein the aluminum alloy is a can body aluminum base alloy having Mn, Cu, Si and Mg as alloying elements therein.

31. A method as defined in claim 1, wherein the quenching in the first sequence is carried out by spraying a cooling fluid onto the hot feedstock.

32. A method as defined in claim 1, wherein the quenching in the first sequence cools the hot rolled feedstock from above 600° F. to below 450° F.

33. A method as defined in claim 1, wherein the first and second sequences are carried out without subjecting the feedstock to solution annealing.

34. A method as described in claim 18, wherein the quenching in the first sequence cools the hot rolling feedstock at a rate fast enough to prevent substantial precipitation of alloying elements from solid solution.

35. A method as defined in claim 18, wherein the aluminum alloy is a can body aluminum base alloy having Mn, Cu, Si and Mg as alloying elements therein.

36. A method as defined in claim 18, wherein the quenching in the first sequence is carried out by spraying a cooling fluid onto the hot feedstock.

37. A method as defined in claim 18, wherein the quenching in the first sequence cools the hot rolled feedstock from above 600° F. to below 450° F.

38. A method as defined in claim 18, wherein the first and second sequences are carried out without subjecting the feedstock to solution annealing.

39. A method as described in claim 24, wherein the quenching in the first sequence cools the hot rolling feedstock at a rate fast enough to prevent substantial precipitation of alloying elements from solid solution.

40. A method as defined in claim 24, wherein the aluminum alloy is a can body aluminum base alloy having Mn, Cu, Si and Mg as alloying elements therein.

41. A method as defined in claim 24, wherein the quenching in the first sequence is carried out by spraying a cooling fluid onto the hot feedstock.

42. A method as defined in claim 24, wherein the quenching in the first sequence cools the hot rolled feedstock from above 600° F. to below 450° F.

43. A method as defined in claim 24, wherein the first and second sequences are carried out without subjecting the feedstock to solution annealing.

* * * * *

UNITED STATES PATENT AND TRADEMARK OFFICE

CERTIFICATE OF CORRECTION

PATENT NO. : 6,391,127 B1
DATED : May 21, 2002
INVENTOR(S) : Gavin F. Wyatt-Mair et al.

It is certified that error appears in the above-identified patent and that said Letters Patent is hereby corrected as shown below:

Column 10,
Line 58, insert -- claim 1 --.

Signed and Sealed this

Eighteenth Day of October, 2005

JON W. DUDAS
*Director of the United States Patent and Trademark Office*